United States Patent [19]

Burke

[11] Patent Number: 4,701,192

[45] Date of Patent: Oct. 20, 1987

[54] VACUUM SYSTEM

[75] Inventor: David D. Burke, Midlothian, Va.

[73] Assignee: Tidewater Industrial Components, Inc., Richmond, Va.

[21] Appl. No.: 902,080

[22] Filed: Aug. 28, 1986

Related U.S. Application Data

[63] Continuation of Ser. No. 740,254, May 31, 1985, abandoned.

[51] Int. Cl.[4] ..... B01D 45/12

[52] U.S. Cl. ..... 55/213; 15/319; 55/273; 55/344

[58] Field of Search ..... 15/314, 319; 55/21, 55/211, 213, 273, 342–346, 350, 419

[56] References Cited

U.S. PATENT DOCUMENTS

| | | | |
|---|---|---|---|
| 3,011,925 | 12/1961 | Holtzclaw | 15/319 |
| 3,050,767 | 8/1962 | Rankin | 15/319 |
| 3,505,791 | 4/1970 | Breslin | 15/314 |
| 3,541,593 | 11/1970 | Weston | 55/344 X |
| 3,735,566 | 5/1973 | Laliwala | 55/273 |
| 4,292,053 | 9/1981 | Kemillieux | 55/273 X |
| 4,521,226 | 6/1985 | Alig et al. | 55/21 |

FOREIGN PATENT DOCUMENTS

| | | | |
|---|---|---|---|
| 0099199 | 8/1978 | Japan | 55/213 |

*Primary Examiner*—Charles Hart

*Attorney, Agent, or Firm*—John F. C. Glenn

[57] ABSTRACT

Multiple inlet vacuum system having parallel exhausters, air admission valves upstream of inlets, and differential vacuum sensors and exhauster amperage sensors controlling the valves.

11 Claims, 1 Drawing Figure

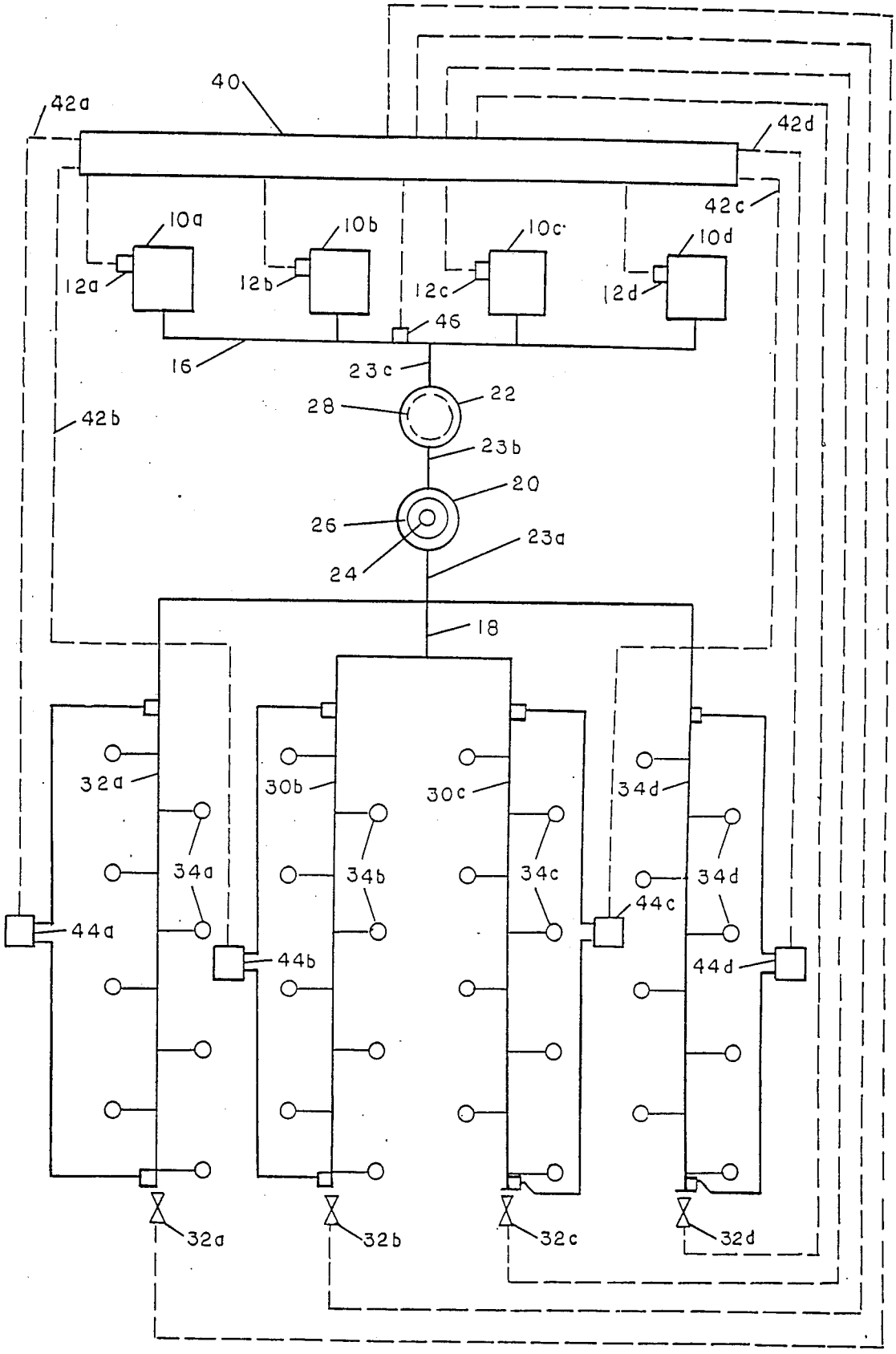
40
42a
42d
42c
10a
10b
10c
10d
12a
12b
12c
12d
46
16
23c
22
28
42b
23b
20
26
23a
24
18
32a
30b
30c
34d
34a
34b
34c
34d
44c
44a
44b
44d
32a
32b
32c
32d

VACUUM SYSTEM

This application is a continuation of application Ser. No. 740,254, filed May 31, 1985, and now abandoned.

BACKGROUND OF THE INVENTION

Multiple vacuum inlets are frequently required for industrial purposes to remove dust and other light trash at work stations, and for domestic and other purposes where it is more convenient to carry a vacuum hose to an inlet than it would be to transport a powered suction unit along with the hose. Many inlets can be connected to one vacuum conduit, but if more than a few are connected along one length of the conduit, some basic problems have to be faced. There is a need for the diameter of the conduit to be large enough to permit passage of the sum total of all the air from the inlets when they are all open, and yet small enough to keep the air moving through the conduit at a speed sufficient to move trash along the conduit instead of letting it settle to the bottom of the conduit where it extends horizontally. If the conduit diameter is too small for the number of inlets when all are open at once, there will be insufficient vacuum differential pressure at some of the inlets furthest upstream. If the conduit diameter is too large, either along all of the conduit, or near its downstream end, there may be insufficient movement of air to keep the trash moving when only a few of the inlets are open.

All this has led conventional designers of such equipment to subdivide large numbers of inlets into separate systems each having a limited number of inlets connected through a common conduit to a separately powered vacuum unit. This is expensive, and can result in shutting down all of the inlets in one such subdivision when its power unit ceases to operate for any reason.

SUMMARY OF THE INVENTION

In accordance with the present invention, a multiple inlet vacuum system is provided with a manifold connected to a plurality of feeder conduits each connected to a plurality of inlets for sucking up trash, a plurality of vacuum generating exhaust units each powered independently of the others but all connected in parallel to the manifold, an air cleaning system to protect the exhausters, and an independently operable valve for each feeder conduit upstream of all the inlets attached to that conduit. A control system operates the exhausters on a generally sequential basis, so that their loads average about the same and only as many exhausters operate as are needed for the load at the time, and operates the feeder conduit valves to accomplish the following: (a) when amperage through an exhauster operating alone falls to a minimum preset level, due to few of the inlets being open a feeder valve is opened to admit air until the need for air is supplied by the opening of more inlets or until another valve is opened to supply the needed air; (b) to avoid clogging, the feeder conduits are periodically and sequentially blown out by opening their valves in turn; and (c) when conditions are sensed in a feeder conduit that it is likely to become clogged with solids received through its inlets, the upstream valve on that inlet is opened to blow out the accumulation for purposes of sensing such conditions, a sensor is preferably provided for sensing air pressure differences between opposite ends of each feeder conduit or the trash itself might be sensed by a laser beam or viewed through a sighting part.

The invention permits selection of conduit diameters which provide for adequate air flow regardless of possible variations in the numbers of vacuum inlets that might be open in the course of operation. In other words, if conduit diameter is big enough for all of the inlets connected to it when they are all open, the problem of clogging due to slower air movement when some of the inlets are closed is overcome by the above-described operation of the air admission valves. Moreover, one or more of the vacuum generating units can be inactive without shutting down any part of the vacuum system, if the remaining unit or units are provided with sufficient excess power or if it can safely be assumed that over the whole system not all of the inlets will be open at once.

Other advantages, objects and details of the invention will become apparent as the following detailed disclosure proceeds.

BRIEF DESCRIPTION OF THE DRAWING

The accompanying drawing schematically illustrates a presently preferred embodiment of apparatus for practicing the invention.

DETAILED DESCRIPTION OF PRESENT PREFERRED EMBODIMENT OF THE INVENTION

Referring now more particularly to the accompanying drawing, there is shown a series of multistage centrifugal exhausters 10*a, -b, -c* and *-d* for generating vacuum at their inlets at subatmospheric pressure. Each is powered by its own electric motor, and these motors are independently operable through their respective controls 12*a, -b, -c* and *-d*. The exhausters have their air inlets connected through a manifold 16 connected to a juncture 18 through air cleaning units 20 and 22. Connecting conduits 23*a, -b* and *-c* extend respectively between juncture 18 and cleaning unit 20, between units 20 and 22, and between unit 22 and manifold 16. The upstream unit 20 is a cyclone separator which centrifically separates air from solids 24. These solids collect at the bottom of the unit and are periodically removed through a bottom opening 26 which is kept closed to admission of air during operation of unit 20. The downstream unit 22 has fabric filters 28 inside for collecting dust, and these filters are mounted so that some can be cleaned while others remain in operation. The construction and operation of air cleaning units 20 and 22 are entirely conventional.

Juncture 18 is connected to one end of each of a plurality of feeder conduits 30*a, -b, -c* and *-d*. The other ends of the feeder conduits are respectively connected to air flow valves 32*a, -b, -c* and *-d*. A plurality of vacuum inlets 34*a* are connected along the length of feeder conduit 30*a* between its ends, and similar inlets 34*b, -c* and *-d* are connected along feeder conduits 30*b, -c* and *-d*. These inlets are normally closed, but one or more are opened when connected to hoses for sucking up trash in adjacent areas.

Valves 32*a–d* control admission of air at substantially atmospheric pressure to the upstream ends of feeder conduits 30*a–d*. Each valve is normally closed but is openable for the purposes of (a), (b) and (c) mentioned above.

A remote control unit 40 (such as an Allen Bradley PLC-Mini 2/15 Programmable Controller) is connected through lines 42*a, -b, -c* and *-d* to air pressure differential sensors 44*a, -b-, -c* and *-d*. These sensors are respectively connected to feeder conduits 30*a–d* for purposes of determining vacuum differential between the opposite ends of each feeder conduit. Each of these sensors is preferably a "Photohelic" pressure-switch gage of Dwyer Instruments, Inc., Michigan City, Ind., having one air tube connection extending between it and the end of a feeder conduit downstream of its inlets, and another air tube connection extending between it and the end of the same conduit upstream of its inlets but downstream of its air admission valve. Through these tubes the sensor determines the vacuum level at opposite ends of the feeder conduit, and the associated switch is adjustably preset to send a signal to control unit 40 and thence to the air admission valve on the conduit. This signal opens the valve when the vacuum differential level sensed by the sensor reaches a point which would indicate a blockage is about to occur in the conduits, thus ensuring that it remains clear. Opening the valve will clear the conduit and the vacuum differential will return to the level at which it will cause the valve to close again.

A pressure sensor 46 is mounted on manifold 16 and connected through line 48 to controller 40. This sensor monitors the pressure in manifold 16 and signals controller 40 when the pressure rises above and when it falls below adjustable preset levels. In addition, each of the exhausters 12*a,-b,-c* and *-d* has an ammeter in its safety control 12 *a, -b, -c,* or *-d* which senses whenever the exhauster runs below $\frac{1}{3}$ of its rated amperage. Controller 40 is programmed to turn on as many of the exhausters as are required to produce at least a minimum level of vacuum for which sensor 46 is preset, and to turn off the exhausters one by one, whenever sensor 46 signals that the vacuum in manifold 16 is stronger than the upper level for which sensor 46 is preset. Controller 40 is also programmed to cause the exhausters to go on and off in a progression among them which assures that over an extended period, they all average about the same workload. Controller 40 is also connected to monitor the amperage through each of the motors driving the exhausters. When only one exhauster is working, and its amperage drops to a level approaching its above mentioned safety cutoff level, controller 40 is programmed to open at least one of the valves 32*a, -b, -c* or *-d,* in order to provide more air for purposes of providing a load requiring the amperage in question. Controller 40 is also programmed for periodically opening the valves 32*a, -b, -c* and *-d,* one by one, for purposes of blowing any residual trash out of the feeder conduits.

While methods and apparatus for practicing the invention have been illustrated and described, it will be understood that the invention is not limited thereto, but rather by the scope of the following claims.

I claim:

1. A multiple inlet vacuum cleaning system, comprising a group of independently openable and closeable collection inlets for sucking in air and trash carried in by the air, means to remove trash from said air, a common conduit connected to said collection inlets, vacuum generating means connected to draw air from the common conduit at a position along the common conduit downstream of said collection inlets, air inlet means openable to admit enough air to the common conduit to blow out residual trash therein, means to sense conditions indicating low flow of air through the common conduit likely to leave residual trash therein, such as when few collection inlets are open, and means responsive to the sensing means for opening said air inlet means when such low flow air is sensed.

2. A multiple inlet vacuum cleaning system according to claim 1, in which said air inlet is positioned upstream of said collection inlets and the sensing means is adapted to sense air pressure in the common conduit upstream and downstream of the collecting inlets.

3. A multiple inlet vacuum cleaning system according to claim 1, comprising means responsive to the sensing means for controlling operation of the vacuum generating means.

4. A multiple inlet vacuum cleaning system, comprising independently openable and closeable collection inlets for sucking in air and trash carried in by air, means to remove trash from said air, a plurality of common conduits each connected to a different group of said collection inlets, vacuum generating means connected to draw air from each of the common conduits at a position along the common conduit downstream of its connected group of said collection inlets, and air inlet means on each common conduit openable to admit enough air to the common conduit to blow out residual trash therein when too few of the connected collection inlets are open to blow out the trash.

5. A multiple inlet vacuum cleaning system according to claim 4 comprising control means connected to operate each of said power means, pressure sensing means connected to each of said feeder conduits, and means connecting said sensors to said control means, said control means being responsive to said sensors for operating the vacuum generating units to draw air and trash the feeder conduits.

6. A multiple inlet vacuum cleaning system according to claim 5, in which each of said sensors is connected to sense pressure in a feeder conduit upstream and downstream of the conduit's vacuum inlets, and to generate a signal to the controller based on the sensed difference in pressure therebetween.

7. A multiple inlet vacuum cleaning system according to claim 5, in which the control means is programmed to sequentially operate the vacuum generating means so that their average operating loads will become substantially equalized.

8. A multiple inlet vacuum cleaning system according to claim 5, comprising means to operate each valve, and means connecting each valve operating means to the control means for operation by the control means.

9. A multiple inlet vacuum cleaning system according to claim 8, comprising a means to sense current through each power means vacuum generating each said current sensing means being connected to signal the control means when the current falls to a preset level, and the control means being programmed to open a valve in response to said signal.

10. A multiple inlet vacuum cleaning system according to claim 9, in which the control means is programmed to operate the valves sequentially until the current sensing means signals when the current rises to a preset level.

11. A multiple inlet vacuum cleaning system according to claim 8, in which the control means is programmed to periodically open the valves one at a time in sequence, thereby blowing out any accumulation of trash in the feeder conduits.

* * * * *